United States Patent [19]

Kroger

[11] Patent Number: 4,765,775

[45] Date of Patent: Aug. 23, 1988

[54] DIKE ASSEMBLY

[75] Inventor: David G. Kroger, Hudson, Ohio

[73] Assignee: Magnum Fiberglass Products Inc., Aurora, Ohio

[21] Appl. No.: 943,743

[22] Filed: Dec. 19, 1986

[51] Int. Cl.[4] ..... E02B 7/02

[52] U.S. Cl. ..... 405/52; 52/102; 405/128; 446/112

[58] Field of Search ..... 405/115, 107, 128, 52; 446/112, 105, 127; 256/24, 19, 25; 52/102, 561, 584, 588

[56] References Cited

U.S. PATENT DOCUMENTS

| | | | |
|---|---|---|---|
| 1,061,637 | 5/1913 | Schwarz | 446/105 |
| 1,073,278 | 9/1913 | Mosher | 405/107 |
| 1,284,946 | 11/1918 | Sweeney | 405/107 |
| 1,898,297 | 2/1933 | Fox | 446/105 X |
| 2,407,927 | 9/1946 | Hayden | 446/105 X |
| 3,032,919 | 5/1962 | Amsler | 446/112 |
| 3,872,620 | 3/1975 | Daenen | 446/112 |

FOREIGN PATENT DOCUMENTS

| | | | |
|---|---|---|---|
| 174934 | 2/1917 | Canada | 446/105 |
| 2077879 | 12/1981 | United Kingdom | 446/112 |

*Primary Examiner*—Dennis L. Taylor
*Attorney, Agent, or Firm*—Oldham & Oldham

[57] ABSTRACT

An environment protecting dike assembly is disclosed comprising interlocking, plastic, wall shaped components which can be erected as a dike wall around storage tanks or other liquid containing vessels. The components of the assembly are of modular construction, permitting dikes of different configuration and size to be constructed. When erected on a liquid impermeable substratum such as earth covered with plastic sheeting, the assembly forms an effective liquid barrier, preventing liquids contained within the assembly from escaping, as, for example, in the event of a storage tank rupture.

15 Claims, 6 Drawing Sheets

FIG.-6
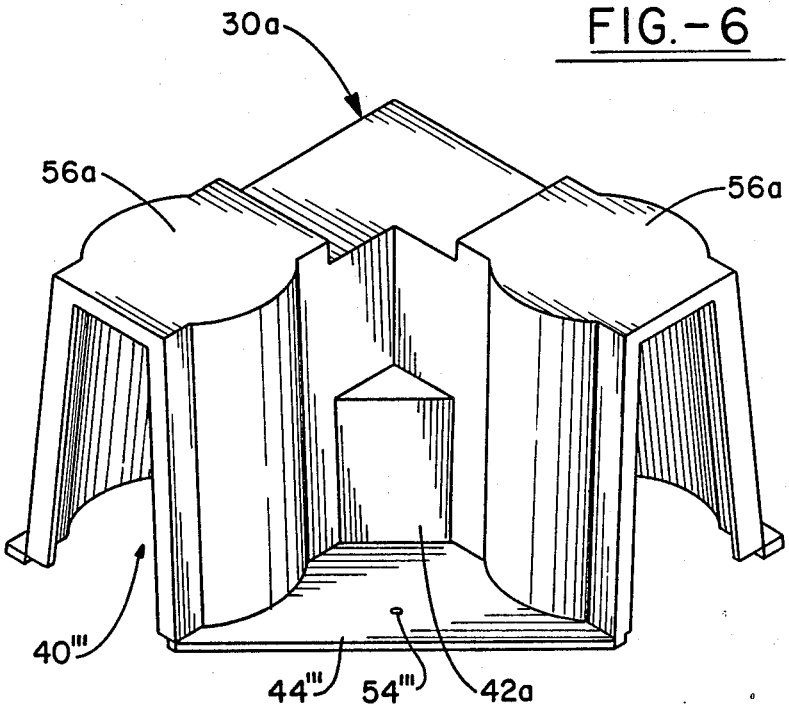
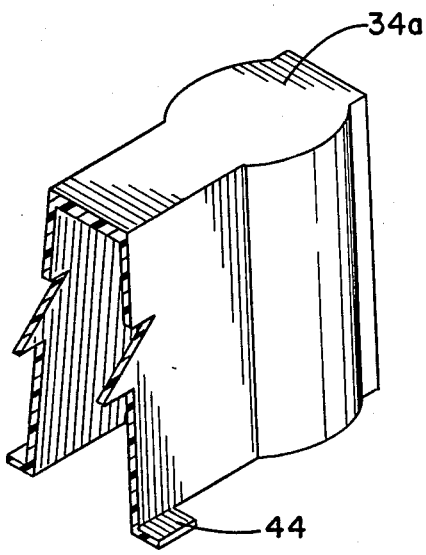
FIG.-7

DIKE ASSEMBLY

This invention relates to environmental protection structures. More particularly, this invention relates to diked enclosures and diking assemblies designed to prevent the escape of inadvertantly spilled liquids. Specifically, this invention relates to portable dike assemblies which may be assembled or disassembled on a substantially liquid impermeable surface in their place of use around storage containers, particularly storage tanks, used to contain liquids.

TECHNICAL FIELD

For some time, people around the world, particularly those in this country, have become increasingly aware of the ecology, their environment, and the adverse affects which accompany its misuse, including particularly pollution. Numerous studies have been done which establish the physiological impact of pollutants, especially chemical pollutants, on mankind. Such effects can include temporary or permanent discomfort, incapacitation, and even cancer. Responding to this threat, actual and perceived, present and potential, a great many laws have been passed, both at the state and federal levels, providing for fines, injunctions, and even prison terms for companies and individuals found guilty of polluting the environment, sometimes even in instances where the pollution occurs accidentally. In addition, there exists the possibility of civil suits as well, which carry the threat of serious, or even ruinous damages when a serious occurance is involved. In this connection, it has long been recognized that one of the more serious, potential pollution exposures is that involving the possible failure of storage tanks or other large liquid containers holding dangerous chemicals, oil, or even relatively innocuous liquid materials, the release of which in small quantities would be relatively harmless. Apart from the liability aspect, however, when accidental release of liquid material from such containers occurs, it is oftentimes desireable to avoid the adverse financial consequences stemming from the loss of spilled material by recovering the material from protective structures surrounding the containers. It is also sometimes desirable to have a dike structure into which liquids may be deliberately placed for one reason or another.

BACKGROUND ART

In the past, provision has been made for confining liquids inadverently spilled from storage vessels containing them, and for retaining liquids generally, by a variety of means including earthen dikes, concrete retaining walls, and by similar structures. While these methods have some advantages, they are offset by a number of equal or greater disadvantages. For example, while earthen dikes are inexpensively and quickly built about liquid storage containers, or formed into a reservoir structures capable of containing liquids, they are permeable to penetration by liquids, and therefore, of only temporary value. In addition, when the earth forming them becomes contaminated by such penetration, it creates a severe disposal problem. In addition, earthen dikes are readily broken down by travel over them, by impact from vehicles, or otherwise. Furthermore, due to dirt's inherent angle of repose, earthen dikes require a considerable amount of space to erect.

Concrete is superior to earthen dikes in that it may readily be formed into liquid impermeable walls. On the other hand, concrete walls require extensive, and expensive, forming operations, including the placement of reinforcing steel bars. Also, concrete basin walls and dikes often develop cracks which allow the contained liquids to escape from them. A still further disadvantage with both earthen dikes and concrete containing walls is that neither is portable and, therefore, they are useful at only one location.

DISCLOSURE OF THE INVENTION

In light of the foregoing, a first aspect of the invention is to provide a dike structure assembly which may be easily assembled, and one which is both light and portable.

A further aspect of the invention is the provision of a dike assembly which is capable of rapid assembly and disassembly at the location where the dike is required.

A further aspect of the disclosed invention is the provision of an inexpensive dike structure, one capable of effectively containing the liquids impounded behind it.

Another aspect of the invention is to provide a dike structure assembly formed from modular parts, making it suitable for diking areas of varying dimensions, where the retention of liquids is required.

Yet another aspect of the invention is the design of a dike assembly which makes it difficult for animals and children to trespass into, but one which allows egress from the diked area in the event of such trespass.

Another aspect of the invention is to provide a dike assembly which is not only substantially inpenetrable to the contained liquids, but one which is extremely durable, and which has a long useful life.

The foregoing and other aspects of the invention which will become apparent as the detailed description procedes are achieved by a modular, interlocking dike assembly comprising in combination:

strut member components;
corner member components;
fastening means, and optionally,
strut member couplers, said strut member components having ends provided with strut terminal posts, terminal post receiver areas, or some combination thereof, with at least some of said strut member components having strut terminal posts on at least one end thereof by which said strut member components may be connected, to said corner member components, and when present to said strut member couplers, said strut member couplers and said corner member components having terminal post receiver areas adapted to connectably enclose said strut terminal posts, said fastening means permitting said dike assembly to be fastened to a substratum.

Other aspects of the invention are attained by a diked enclosure comprising in combination:

strut member components;
corner member components;
a substratum;
fastening means, and optionally,
strut member couplers, said strut member components having strut terminal posts at the ends thereof, said strut member components being connected to said corner member components, and when present to said strut member couplers, by means of terminal post receiver areas contained by such strut member couplers and by said corner member components, said strut and corner member components, and when present, said strut member couplers being fastened to said substratum by said fastening means.

Still other aspects of the invention are provided by a modular interlocking dike assembly comprising in combination:

radial strut member components;
fastening means, and optionally
radial strut member couplers, said radial strut member components having ends provided with strut terminal posts, terminal post receiver areas, or some combination thereof, while said radial strut member couplers are provided with terminal post receiver areas, so as to enable said radial strut members, and when present said radial strut member couplers, to be assembled into a circular dike assembly.

BRIEF DESCRIPTION OF THE DRAWINGS

The invention will be better understood when reference is had to the accompanying drawings forming a part hereof in which:

FIG. 6 is an isometric view of another variant of a corner member of the invention.

FIG. 7 is a broken away isometric view of the end of another strut member variant of the invention.

BEST MODE FOR CARRYING OUT THE INVENTION

Figure 1:
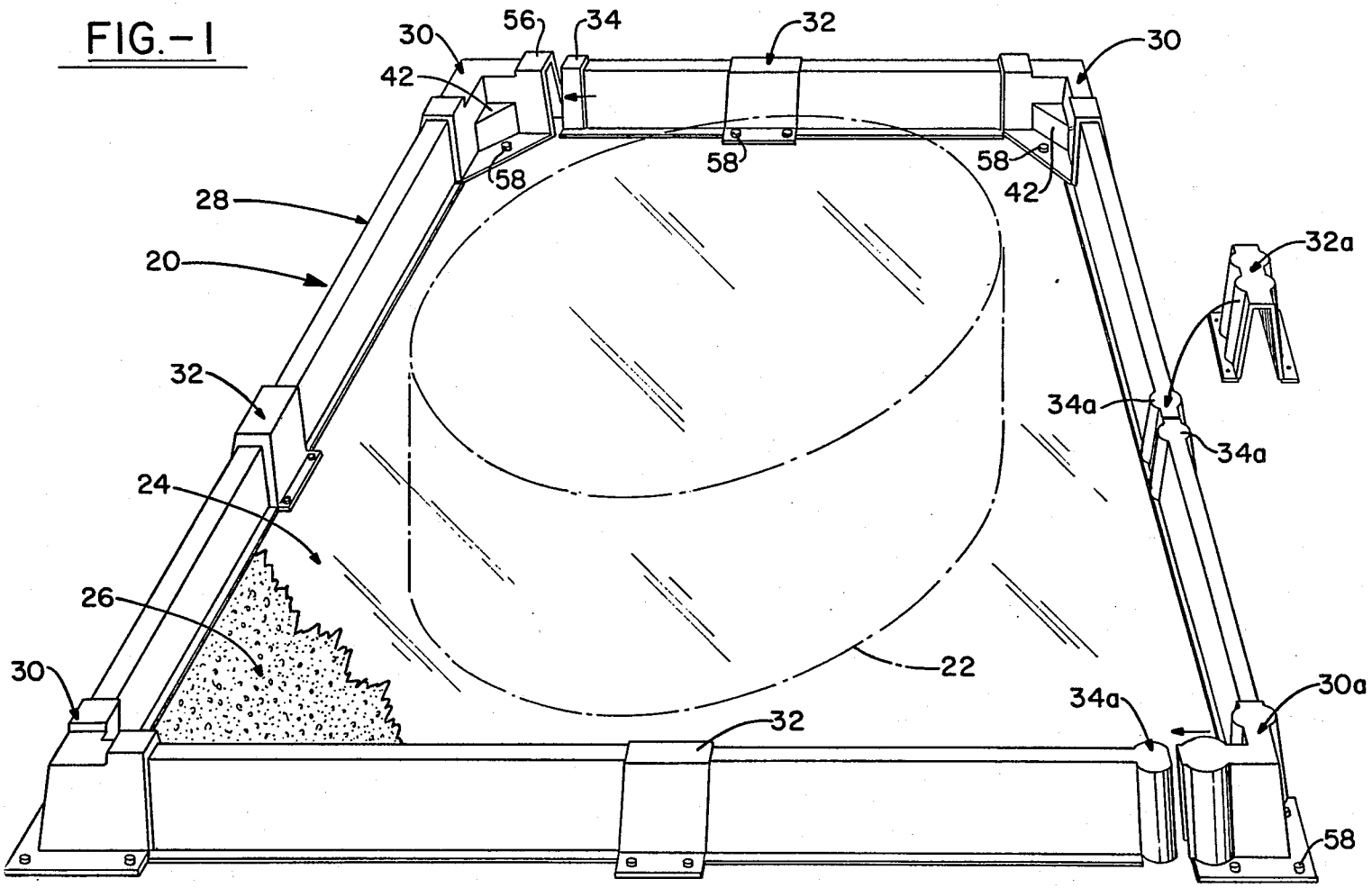
FIG. 1 is an isometric view of one example of a dike configuration surrounding a storage tank, utilizing the dike assembly components of the invention, and showing variations of construction thereof.

FIG. 1 shows an isometric view of a typical dike assembly 20, protecting the contents of a liquid containing storage tank 22. Dike assembly 20 comprises strut members 28 adapted to be interconnected with corner members 30 by means of strut terminal posts 34 and terminal post receiver areas 56. The Figure also illustrates the modular construction of the dike assembly 20, and the manner in which it may be enlarged by interconnecting strut members 28 with strut member couplers 32. A variation of dike component interconnection is also shown in the Figure comprising strut member couplers 32*a*, and corner member 30*a*, designed to be employed with the strut terminal post variation 34*a*. In FIG. 1, dike assembly 20 is shown mounted on a plastic film sheeting 24, covered with gravel 26. The dike assembly components, including the corner members, strut members, and the strut member couplers, can be made from a variety of materials including such materials as polyethylene, polypropylene, polyvinylchloride, and the like; however, they have been found to be particularly useful for the purposes of the invention when made from fiberglass reinforced plastics. Fabrication of the dike components from fiberglass reinforced plastics is accomplished in the usual manner employing molds simultaneously sprayed with short glass fibers, polyester resins, and a catalyst. A final coat of polyester resin may be sprayed over the components to produce a particularly smooth finish if preferred. The dike components may also be build up from woven fiberglass fabrics and polyester resin, or from a combination of such fabrics and resins, together with the short glass fibers, polyester resin, and catalyst mixture referred to. Polyester resins of the type described are available in the form of general purpose resins, acid resistant resins, as well as other types, and the selection made will depend upon the use to which the dike assembly is to be put, e.g., the liquids to be contained. Resins other than polyester resins, including those of the epoxy type, may also be employed if desired.

Due to its modular design, the strut members may be connected together with strut member couplers to form a dike assembly of the particular size required. Typically in the process of installation, the site at which the dike assembly is to be erected is graded, a sheet of plastic film, usually in the form of strips fastened together, for instance with an adhesive, is layed over the soil, and a protecting layer of gravel is distributed on top of the plastic film. Any of the various types of plastic film including polyethylene, polypropylene, polyvinylchloride, or others may be used. While the distribution of gravel on top of the film is not necessary, it serves the purpose of allowing the film to be walked upon without damage, and depending upon its depth, the gravel provides a desirably dry top surface, free from the temporary accumulation of rain water and the like. If desired, the dike assembly can be erected on a concrete pad, or other substantially liquid impermeable structure.

Figure 2:
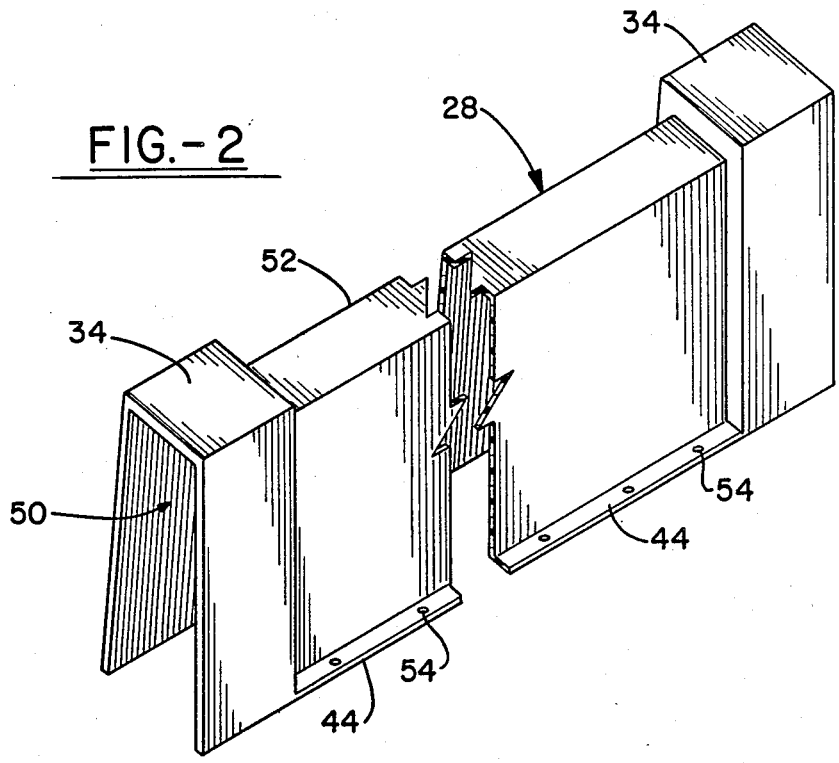
FIG. 2 is an isometric view of a strut member of the invention.
Figure 8:
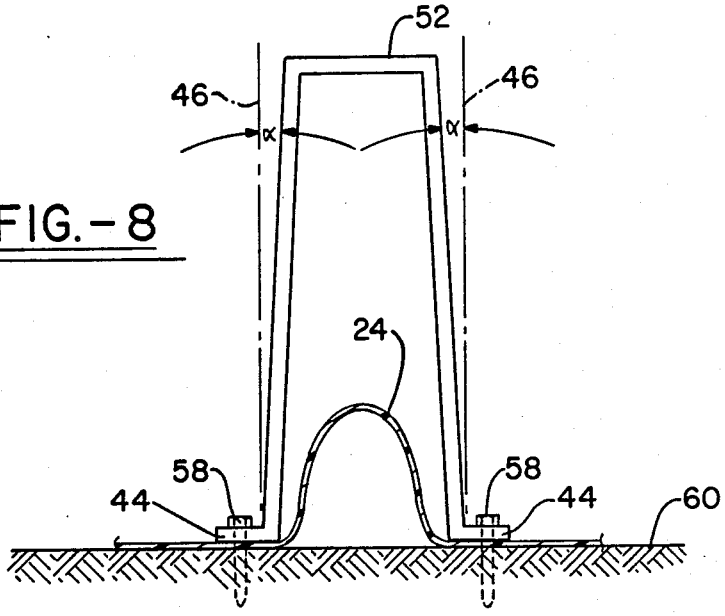
FIG. 8 is a transverse cross-section of a strut wall fastened in its position of use showing one type of interconnection with plastic film forming part of a substratum.

FIG. 2 shows an isometric view of a strut member 28 comprising a strut wall 52, at the ends of which are located strut terminal posts 34 which may have open ends 40 as shown, or alternatively, closed ends. Strut wall 52 has a fastening flange 44 attached to one or both bottom sides thereof, penetrated at intervals, desirably about 3 to 4 feet, by anchor holes 54 which are used to fasten the strut member to the substratum, as will be hereinafter be described. The shape of strut member 28 may vary considerably, for example, the strut walls 52 and the walls of the strut terminal posts 34 may be vertical, or they may be deposed at an angle from the vertical, as illustrated in FIG. 8. Similarly, the top of the strut member may be horizonal, rounded, or otherwise. It has been found desirable, however, to form the strut member 28, including the strut wall 52 and the walls of the strut terminal post 34, at an angle from the horizontal, that is to say in the general form of a truncated triangle.

FIG. 2 illustrates a strut member 28 with strut terminal posts 34 on each end. Alternatively, however, since the dike assembly is modular in character, the strut members can also be formed with a terminal post 34 on one end, and a post receiver area 56 on the other end, as well as with post receiver areas on both ends. When such alternative strut members are employed, struts, and combinations of them will be selected which are appropriate to assembly of the dike shape desired, from the structural components available.

In addition, while a dike structure will commonly be assembled in any of various rectangular shapes, employing component members, including corner members 30, the dike structure can also be formed from radial strut members, i.e., curved, rather than straight members as shown in FIG. 2, having radii and lengths suitable for the area to be enclosed. In such case, the dike structure can be assembled from radial struts, each of which has a strut terminal post on one end, and a port receiver on the other end. Radial struts having terminal posts on each end can also be used, however, in conjunction with curved, radial strut member couplers having the same radius as the radial struts.

The dimensions of the strut member 28 may be varied within broad limits. Generally, however, ease of handling dictates that strut members of about 12 to 16 feet long and from about 2½ feet to 3½ feet tall be used, since they are easy to handle, and are suitable for most applications. Where angled walls are employed, it has been found useful to employ an angle of about 5° to 10° from the vertical, in conjunction with a strut member base of about 10 to 14 inches wide, and a terminal post base of about 12 inches to 16 inches wide. The length of the terminal post may also vary, but a length of about 4 to 8 inches is convenient. Strut members exhibiting such comformation and dimensions have been found to be both attractive and strong.

Figure 3:
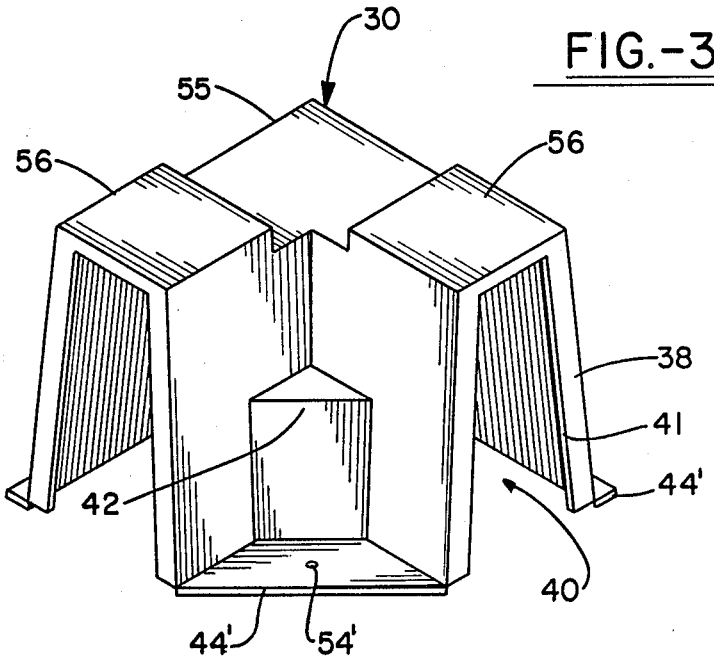
FIG. 3 is an isometric view of one type of corner member of the invention.

FIG. 3 shows a corner member 30 comprising hollow, or female, terminal post receiver areas 56, connected at a right angle by connector section 55. Corner member 30 contains step platform 42, as an integral part thereof, and the corner member is provide with fastening flanges 44', penetrated at intervals by anchor holes 54'. In the corner member 30 shown, the walls of the corner member are disposed at the same angle from the vertical as previously described in connection with the strut members of FIG. 2. In FIG. 3, a strut access opening 40' is defined by an opening flange 38 around the ends of corner member 30. Opening flange 38 serves the purpose of locking the strut terminal post 34 of strut number 28 in place in the corner member 30. Step 42 is provided in order to allow egress from the interior of the dike assembly 20 by children, animals and the like who may in one way or in another become trapped within the assembly. Edge 41 of flange 38 provides a surface for spreading a liquid impermeable adhesive mastic between corner member 30 and strut member 28, enabling such members to form a secure, substantially liquid tight assembly. Alternatively, gaskets may be employed to obtain an effective liquid seal. Normally, the clearance between edge 41 and the adjacent wall 52 of strut number 28 will be from about ⅛ to ¼ inch. Various types of mastic may be used for sealing purposes including sealants of the butyl type, silicon sealants, and others. The dimensions of terminal post receiver compartment 56 of corner member 30 will be such as to accomodate the strut terminal post 34 which is intended to fit within it. The dimensions of connector section 55 may be varied as desired; however, its height will generally correspond to the height of strut wall 52. The height and area of step 42 are relatively unimportant, it simply being desirable to provide a step by means of which easy access out of the dike assembly area 20 may be had.

Figure 4:
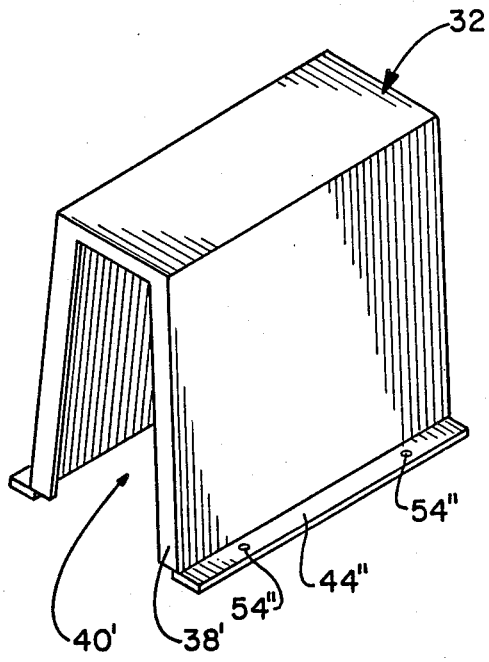
FIG. 4 is an isometric view of a strut member coupler which can be used to connect the strut members of FIG. 2.

FIG. 4 shows a strut member coupler 32 having a strut opening 40'' defined by flange 38', which like the similar flange 38 in FIG. 3, serves the purpose of locking strut members 28 in place. The strut member coupler 32 is equipped with a fastening flange 44'', which is provided with anchor holes 54'' disposed therein. The fastening flange will normally be about 3 to 4 inches wide, similar to the width of the fastening flanges in the other components of the dike assembly. It has been found that a wall thickness of from about ⅛ inch to ¼ inch provides adequate strength and rigidity; however, a nominal wall thickness of about 3/16 inch is preferable. Similar wall thicknesses are suitable for the strut and corner members of the invention. Strut opening 40'' and opening flange 38' will normally the same dimensions and clearances as their counterparts in FIG. 3, since they serve similar purposes. The length of strut member coupler 32 will be choosen so that the terminal post receiver area provided on the interior of the coupler will be sufficient to allow two strut terminal posts to be butted together therein. With strut terminal posts of about 4 to 8 inches long, this requires a strut coupler length of about 8 to 16 inches.

Figure 5:
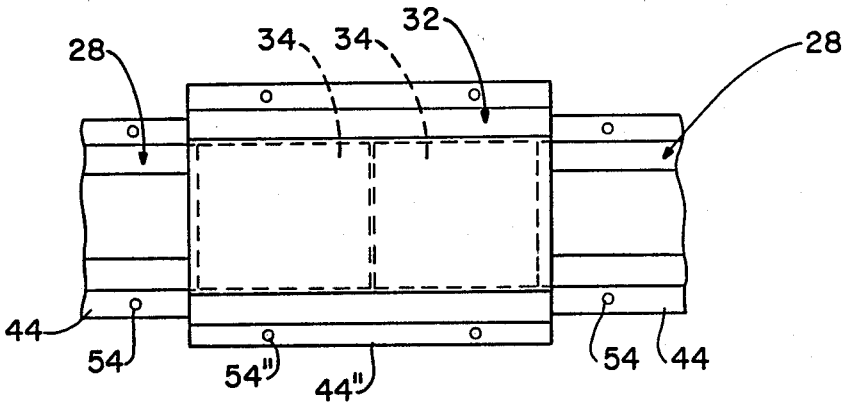
FIG. 5 is a broken away top view of the strut member coupler of FIG. 4, securing two strut members together.

FIG. 5 shows a strut member coupler 32 in which two strut terminal posts 34 have been butted together in a locked position within the strut member coupler. While the strut member coupler must have at least sufficient terminal post receiver area to receive two strut terminal posts positioned substantially against each other, it is desirable that its length not be such as to allow excessive longitudinal movement of the strut members 28.

FIG. 6 shows a slightly different embodiment of a corner member **30*a* in which a terminal post receiver area 56*a* comprises what is referred to herein as a vertically sectioned truncated triangular cylinder. One advantage of the modified corner member 30*a* shown is that strut members 28 are locked in the terminal post receiver areas therein without any need for a flange member 38, which is required in connection with the corner member 30, shown in FIG. 3. The mastic used to seal the juncture between strut member 28 and corner member 30*a* is normally placed about the interior surface of, and adjacent to opening 40''' of the corner member, which has an intersurface clearance relative to the outside of strut wall 52** of from about ⅛ to ¼ inch.

FIG. 7 shows a broken away portion of a strut member 28' having a modified strut terminal post **34*a* in the form of a vertically sectioned truncated triangular cylinder adapted to fit within the terminal post receiver area 56*a* of corner member 30*a*. While the use of strut terminal posts such as 34 and 34*a* provides a very positive, secure connecting coupling between strut numbers 28** and said corner members, other variations of terminals connections are possible.

FIG. 8 shows a transverse section of a strut wall 52, illustrating how the plastic sheeting 24 of the substratum is folded within the interior of the strut wall in order to contain liquid within the dike assembly. The Figure shows an anchor stake 58 securing the strut wall 52 to a substratum, comprising the plastic sheeting 24 and the ground 60. Anchor stakes 58 may be located on both sides of the structural components of the dike assembly 20, or on a single side. Staking on both sides of the components, or if on a single side, on the side designed to contact the contained liquid, is desirable from the standpoint of dike stability. While the length of the anchor stakes 58 may vary, and need only be long enough to hold the structural components of the dike assembly securely to the substratum, normally they will be about 6 to 10 inches long. It is sometimes desirable to seal the juncture between the fastening flange 44 and the plastic sheeting 24 with mastic prior to driving the anchor stakes 58 therethrough in order to minimumize the posibility of liquid seepage past such juncture.

Figure 9:
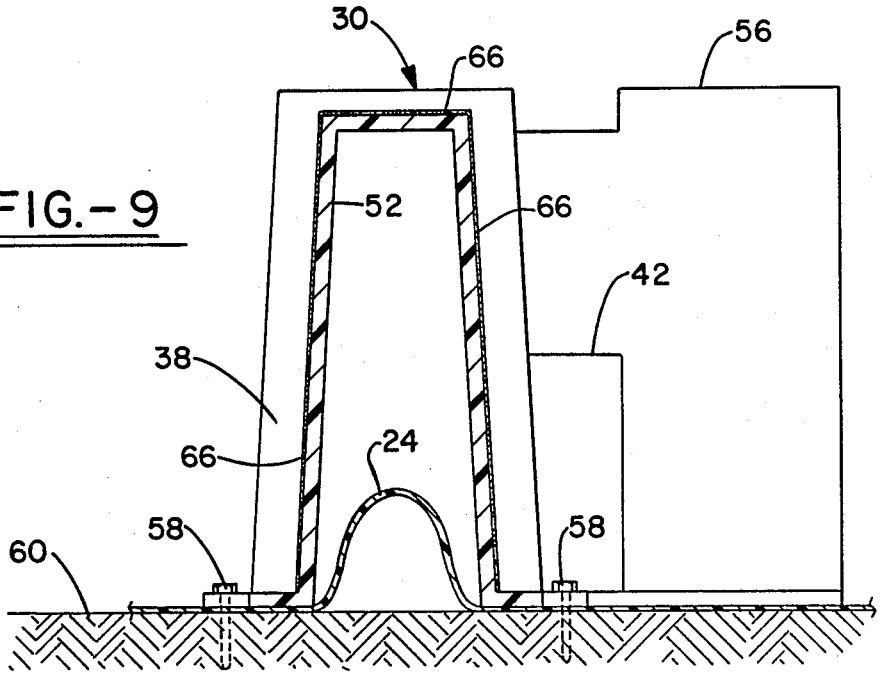
FIG. 9 is a transverse cross-section of the corner member of FIG. 3 showing the interconnection of one of its ends with a strut member and with the plastic film of a substratum.

FIG. 9 shows a transverse cross-sectional view through one end of corner member 30, illustrating the relationship of the mastic sealing layer 62 to the opening flange 38 and strut wall 52. The Figure also shows how plastic sheeting 24 is folded within corner member 30 while being fastened to the substratum comprising plastic sheeting 24 and the earth 60 by means of anchor stakes 58. A mastic layer 62 may also be placed within the terminal post receiver area prior to placing the strut terminal post therein, providing an even better liquid seal, the intersurface clearance therebetween in such case normally being about ⅛ to ¼ inch, although greater clearances are sometimes desirable.

Figure 10:
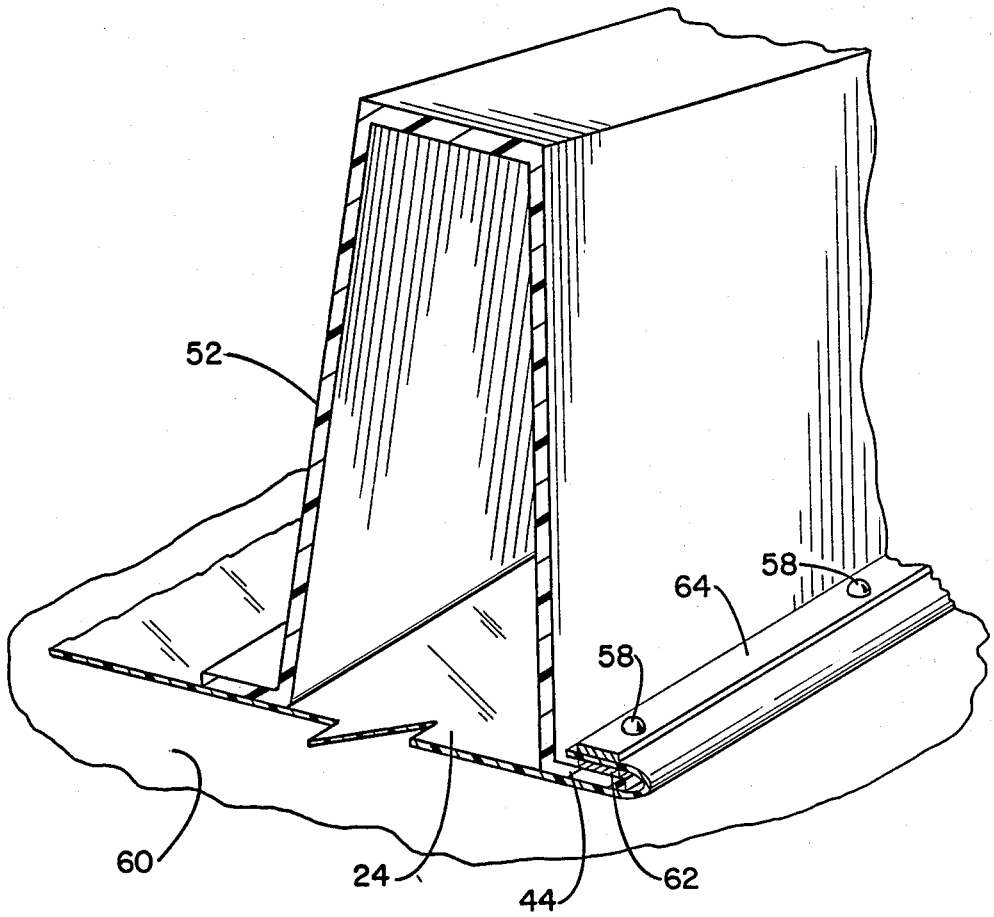
FIG. 10 is a broken away isometric view of a strut wall fastened in its position of use showing another type of interconnection of the plastic film of a substratum with the strut wall.

FIG. 10 shows a strut wall 52 in which sealing between the strut wall 52 and the substratum, comprising plastic sheeting 24 and ground 60, is achieved by folding the plastic sheeting over a layer of mastic sealer 62, spread on fastening flange 44. The lamination thus formed is compressed into substantially liquid impermeable contact by placing a sealing bar 64 on the top thereof prior to driving anchor stakes 58, as shown in the Figure. It is often convenient to provide multiple sealing bars of different lengths to accomodate the differing dimensions of the structural components of the dike assembly employed.

While in accordance with the patent statutes, a preferred embodiment and mode has been presented, the scope of the invention is not limited thereto, but rather is measured by the scope of the attached claims.

What is claimed is:

1. A modular, interlocking dike assembly comprising in combination:

strut member components;
corner member components;
sealing means;
fastening means, and optionally,
strut member couplers, each of said strut member components by itself forming a complete, monolithic wall section of said assembly having ends provided with strut terminal posts, terminal post receiver areas, or some combination thereof, with at least some of said strut member components having strut terminal posts on at least one end thereof by which said strut member components may be connected to said corner member components, and when present to said strut member couplers, said strut member couplers and said corner member components having terminal post receiver areas adapted to connectably enclose said strut terminal posts, said sealing means being provided between said terminal posts and said terminal post receiver areas to prevent the escape of fluids therebetween, and said fastening means permitting said dike assembly to be fastened to a substratum.

2. A dike assembly according to claim 1 in which said strut and corner member components, and said strut member couplers are fabricated from fiberglass reinforced plastic.

3. A portable dike assembly assording to claim 1 in which said fastening means comprise anchor members inserted into the substratum through holes in flanges forming a part of said strut and corner member components, and said strut member couplers, and said substratum is covered with a substantially liquid impermeable layer of plastic.

4. A dike assembly according to claim 3 in which said plastic layer is placed between the top of said flanges and the bottom of sealing bars, and held in that position by anchor members passed through said sealing bars, plastic layer, and flanges, into said substratum, thereby forming a substantially liquid impermeable seal.

5. The dike assembly according to claim 1 in which said corner member components include a projecting step structure as an integral part thereof.

6. A dike assembly according to claim 1 installed around liquid holding storage containers so as to receive liquid spillage therefrom.

7. A dike assembly according to claim 3 in which said substratum comprises a layer of gravel on top of a substantially liquid impermeable plastic film covering soil.

8. A diked enclosure comprising in combination:

strut member components;
corner member components;
a substratum;
sealing means;
fastening means, and optionally,
strut member couplers, each of said strut member components by itself forming a complete, monolithic wall section of said enclosure having strut terminal posts at the ends thereof, said strut member components being connected to said corner member components, and when present to said strut member couplers, by means of terminal post receiver areas contained by said strut member couplers and by said corner member components which connectably enclose said strut terminal posts, said sealing means being provided between said terminal posts and said terminal post receiver areas to prevent the escape of liquids therebetween, and said strut and corner member components, and when present, said strut member couplers being fastened to said substratum by said fastening means.

9. A diked enclosure according to claim 8 in which said substratum is covered with a substantially liquid impermeable layer of plastic.

10. A diked enclosure according to claim 1 in which said strut and corner member components, and when present, said strut member couplers are fabricated from fiberglass reinforced plastic.

11. A diked enclosure according to claim 10 enclosing liquid holding storage containers.

12. A diked enclosure according to claim 8 in which said substratum comprises a layer of gravel covering a substantially liquid impermeable plastic film over soil, and said fastening means comprises anchor stakes inserted in said substratum through holes in flanges forming a part of said strut and corner member components, and when present, said strut member couplers.

13. A modular interlocking dike assembly according to claim 1 in which the portion of said strut member components between the terminal posts thereof has a transverse cross section generally in the shape of a truncated triangle, and said terminal posts also have a generally truncated triangular transverse cross sectional shape, wherein said corner member components contain two terminal post receiver areas having the female transverse cross sectional shapes counterpart of said terminal posts said areas being connected at right angles to each other, and which are areas adapted to receive said terminal posts, and wherein, when present, said strut member couplers also have a transverse cross sectional shaped area, the female counterpart of said terminal posts, and adapted to receive said terminal posts.

14. A modular interlocking dike assembly according to claim 13 in which the transverse cross sections therein described have a shape generally of a vertically sectioned, truncated, triangular cylinder, rather than the shape of a truncated triangle.

15. A modular, interlocking dike assembly comprising in combination:

radial strut member components;

sealing means;

fastening means, and optionally radial strut member couplers, each of said radial strut member components by itself forming a complete monmolithic wall section of said assembly having ends provided with strut terminal posts, terminal post receiver areas, or some combination thereof, while said radial strut member couplers are provided with terminal post receiver areas adapted to connectably enclose said strut terminal posts, so as to enable said radial strut members, and when present said radial strut member couplers, to be assembled into a circular dike assembly, said sealing means being provided between said terminal posts and said terminal post receiver areas to prevent the escape of fluids therebetween.

* * * * *